US009209504B2

(12) United States Patent
Denis et al.

(10) Patent No.: US 9,209,504 B2
(45) Date of Patent: Dec. 8, 2015

(54) MICROWAVE RESONATOR WITH IMPEDANCE JUMP, NOTABLY FOR BAND-STOP OR BAND-PASS MICROWAVE FILTERS

(71) Applicant: THALES, Neuilly-sur-Seine (FR)

(72) Inventors: Stéphane Denis, La Bouexiere (FR); Patrick Fouin, Vern sur Seiche (FR); Gérard Haquet, Chateaubourg (FR); Georges Peyresoubes Peyresoubes, Cholet (FR)

(73) Assignee: THALES, Courbevoie (FR)

( * ) Notice: Subject to any disclaimer, the term of this patent is extended or adjusted under 35 U.S.C. 154(b) by 218 days.

(21) Appl. No.: 13/944,822

(22) Filed: Jul. 17, 2013

(65) Prior Publication Data

US 2014/0022032 A1 Jan. 23, 2014

(30) Foreign Application Priority Data

Jul. 20, 2012 (FR) ..... 12 02065

(51) Int. Cl.

| | |
|---|---|
| ***H01P 7/08*** | (2006.01) |
| ***H01P 1/203*** | (2006.01) |
| ***H01P 1/20*** | (2006.01) |
| ***H01P 11/00*** | (2006.01) |

(52) U.S. Cl.

CPC ..... *H01P 1/20* (2013.01); *H01P 1/2039* (2013.01); *H01P 7/082* (2013.01); *H01P 11/007* (2013.01); *H01P 1/20363* (2013.01); *H01P 1/20381* (2013.01); *Y10T 29/49016* (2015.01)

(58) Field of Classification Search

CPC ..... H01P 1/204; H01P 7/082; H01P 7/088; H01P 1/20381

USPC ..... 333/219, 235, 32–35, 175, 204

See application file for complete search history.

(56) References Cited

U.S. PATENT DOCUMENTS

| | | | | |
|---|---|---|---|---|
| 3,947,934 | A * | 4/1976 | Olson | 29/25.42 |
| 5,153,542 | A * | 10/1992 | Tai et al. | 333/204 |
| 5,697,087 | A * | 12/1997 | Miya et al. | 455/307 |
| 6,998,953 | B2 * | 2/2006 | Yeo et al. | 336/200 |
| 2006/0250199 | A1 | 11/2006 | Ohwada et al. | |

OTHER PUBLICATIONS

Chin-Hsuing Chen et al: "Folded Finite-Ground-Width CPW Quarter-Wave Stepped Impedance Resonator Filters", Microwave Confererence, 2007, (Dec. 11, 2007), pp. 1-4.

Alexander Stark et al: "A Packaged Ultrawideband Filter with High Stopband Rejection [Application Notes]", IEEE Microwave Magazine, vol. 11, No. 5, (Aug. 1, 2010), pp. 110-117.

* cited by examiner

*Primary Examiner* — Robert Pascal
*Assistant Examiner* — Gerald Stevens
(74) *Attorney, Agent, or Firm* — Baker Hostetler LLP

(57) ABSTRACT

A microwave resonator with impedance jump, comprises at least one line of high characteristic impedance of a determined length and one line of low characteristic impedance, at least the line of high characteristic impedance comprising a first line cut, a first link wire of a first determined impedance ensuring an electrical link for the passage of the signal from one side to the other of the first line cut. A method for producing a microwave resonator comprising an adjustment step is also provided.

9 Claims, 6 Drawing Sheets

MICROWAVE RESONATOR WITH IMPEDANCE JUMP, NOTABLY FOR BAND-STOP OR BAND-PASS MICROWAVE FILTERS

CROSS-REFERENCE TO RELATED APPLICATION

This application claims priority to foreign French patent application No. FR 1202065, filed on Jul. 20, 2012, the disclosure of which is incorporated by reference in its entirety.

FIELD OF THE INVENTION

The present invention relates to microwave resonators with impedance jump. Such resonators can notably be included in microwave filters, for example microwave filters of rejection or band-stop type, or even of band-pass type.

BACKGROUND

The devices that operate in so-called microwave frequency bands typically use microwave filters. Among the microwave filters, there are notably filters of rejection or "band-stop" type, the function of which is to reject signals with a frequency contained in a determined frequency band, as well as so-called "band-pass" filters, that allow only signals with a frequency contained in a determined frequency band to pass.

The microwave filters may comprise planar transmission lines and resonators formed by discrete components such as self-inductances and capacitors. The microwave filters are constrained by the tolerances of the elements from which they are made, notably the thickness of the substrate on which the transmission lines are produced, the permittivity and the permeability of the substrate, as well as by the performance tolerance levels of the discrete components used. The variability of all the abovementioned parameters can lead to inadequate manufacturing efficiencies or to performance levels that are overall too random, more particularly in the following cases:

- when the microwave filters have one or more frequency bands cut at low frequency, situated in a passband that is overall relatively wide, this first case being illustrated by FIG. 1 described in detail hereinbelow;
- when the microwave filters are incorporated in multilayer substrate structures, notably in the case where the filters are incorporated in a monolithic subsystem also comprising a large number of elements. In such a case, a filter whose performance levels are situated outside of the desired specifications means scrapping the complete subsystem, and therefore reduced manufacturing efficiency. When a plurality of microwave filters are incorporated in one and the same module, the reduction in manufacturing efficiency is all the more critical;
- when the microwave filters comprise vias. Such a case occurs in particular when the microwave filters comprise resonators with an end that is short-circuited to a ground, as is the case for the microwave filters that are the subject of the present invention;
- when the filters are compact microwave filters produced on substrates with high permittivity and/or permeability, particularly sensitive to the production tolerances and to the electrical parameters such as the permittivity and permeability;

- when the microwave filters are used in systems for which it is necessary to perform an adjustment of the filter in its application context;
- when the microwave filters form multiplexers.

A major problem in the context of the design of microwave filters arises when the stopbands are situated at relatively low frequencies compared to the highest frequencies that the microwave filter has to allow to pass, that is to say the high cutoff frequency of the overall passband of the filter. Hereinbelow, the term "fundamental resonance frequency" will be used to designate the first resonance frequency of a microwave resonator around which the stopband is situated in the case of a band-stop filter, or, similarly, the passband in the case of a band-pass filter, the subsequent resonance frequencies determining the overall passband of the filter.

In order to produce a microwave filter, for example of rejection type, that has a cut frequency band that is narrow and at relatively low frequency, in a passband that is globally wide, it is possible, according to techniques that are known per se, to produce the microwave filter by means of a so-called "mixed" technology, that is to say on the one hand with localized elements, typically capacitors and/or self-inductances, and on the other hand distributed elements: typically coupled parallel lines, as is illustrated by FIG. 4, described in detail hereinbelow. The self-inductances and capacitors used may be components of "SMC" type, SMC standing for Surface-Mount Component. The self-inductances of SMC type that are available typically have resonance frequencies, quality coefficients and tolerances that are inadequate. Also, to a lesser extent, the capacitors of SMC type typically present the same drawbacks. The self-inductances that take the form of air coils offer better performance levels than their monolithic peers of SMC type, but present problems linked to implementation difficulty, in other words mounting and placement that are difficult, as well as performance problems linked to microphony, that is to say phenomena whereby vibrations of the structure can lead to a displacement of the turns of the coil, and consequently the generation by the latter of spurious signals.

The performance levels of such mixed structures are further limited in the field of high frequencies, notably by the localized components. Moreover, the tolerances of these components and their implementation introduce significant spreads in the performance levels of the microwave filter. These spreads limit the performance levels thereof and can result in inadequate manufacturing efficiencies.

According to another technique that is known per se, the microwave filters can be produced without discrete localized elements such as self-inductances or SMC capacitors. According to this technique, the microwave filters may comprise so-called impedance jump resonators, commonly referred to by the acronym SIR, standing for "Stepped Impedance Resonator". Such resonators typically exhibit resonance frequencies higher than the fundamental resonance frequency, differing by multiples of this fundamental frequency. Such resonators are illustrated by FIG. 7, described in detail hereinbelow.

A so-called "invariant" resonator, that is to say with no characteristic impedance jump, made up of a so-called "half-wave" line section, that is to say a line section delimited by two short circuits or by two open circuits, has a fundamental resonance frequency f0, and higher resonance frequencies equal to the multiples of the fundamental resonance frequency F0, i.e. 2F0, 3F0, etc., as is illustrated by FIG. 5, described hereinbelow.

A resonator of invariant type made up of a single so-called "quarter-wave" line section, that is to say a line section delimited by a short circuit and an open circuit, has a first resonance frequency f0, and higher resonance frequencies equal to the odd multiples of the first resonance frequency F0, i.e. 3F0, 5F0 , etc., as is illustrated by FIG. 6, described hereinbelow. Each of the higher resonance frequencies is reflected in "replicas" of the fundamental response, that is to say stray passbands or stopbands, depending on the type of response of the filter.

An SIR resonator of so-called "quarter-wave" type with two sections as illustrated by FIG. 7 makes it possible to separate the first resonance frequency f0 and the second resonance frequency denoted Fres2. The second resonance frequency is then typically much higher than 3f0. The second resonance frequency becomes all the higher as the characteristic impedance ratio of the two sections of the resonator increases.

However, the planar line technologies exhibit producible minimum and maximum characteristic impedance limits which limit the ratio between the second resonance frequency and the first resonance frequency Fres2/F0, and consequently the passband of the microwave filter, denoted BPG.

Furthermore, the SIR resonators are sensitive to the manufacturing tolerances and to the tolerances of the materials used.

SUMMARY OF THE INVENTION

The aim of the present invention is to mitigate the abovementioned drawbacks, by proposing band-stop microwave filters comprising adjustment means allowing for a better control of their performance levels.

To this end, the subject of the invention is a microwave resonator with impedance jump, comprising at least one line of high characteristic impedance of a determined length and one line of low characteristic impedance, at least the line of high characteristic impedance comprising a first line cut, a first link wire of a determined length ensuring a determined impedance at the first line cut, said first line cut being produced substantially at one third of the overall length of the microwave resonator starting from the side of an end of the line of high characteristic impedance opposite to the end of the line of high characteristic impedance situated on the side of the line of low characteristic impedance.

In one embodiment of the invention, the microwave resonator may comprise a second line cut, a second link wire of a second determined impedance ensuring an electrical link for the passage of the signal from one side to the other of the second line cut.

In one embodiment of the invention, the second line cut may be situated between a line with high characteristic impedance and a line with low characteristic impedance.

In one embodiment of the invention, the first line cut can be produced substantially at mid-length of the line with high characteristic impedance.

In one embodiment of the invention, said at least one line with high characteristic impedance and one line of low characteristic impedance can be produced in the form of metal tracks printed on a substrate, in the form of planar line sections of strip or microstrip type.

In one embodiment of the invention, the line of low characteristic impedance can be formed by a stub of butterfly type.

In one embodiment of the invention, the line of low characteristic impedance can be formed by a capacitor mounted on the surface of the substrate, of which a first foil is connected to said second link wire, and a second foil is linked to a reference electrode.

In one embodiment of the invention, the line of low characteristic impedance, the line of high characteristic impedance and the capacitor can be situated on a top face of the substrate, the reference electrode being a ground electrode situated on a bottom face of the substrate, said second foil of the capacitor being connected to the reference electrode by means of a via passing through the substrate.

In one embodiment of the invention, the microwave resonator may be produced in a structure of multilayer type produced in the substrate, the capacitor being incorporated in the multilayer structure.

Also the subject of the present invention is a microwave filter of band-rejection type, characterized in that it comprises a transmission line, coupled to a plurality of microwave resonators according to any one of the embodiments described.

Also the subject of the present invention is a method for producing a microwave resonator or a microwave filter according to any one of the embodiments described, characterized in that it comprises a sequencing of at least the following steps:

- a first step of producing a structure comprising said at least one line of high characteristic impedance, said at least one line of low characteristic impedance, and at least one line cut,
- a second step of characterizing the performance levels of the structure produced in the first step,
- a third step of adjustment during which the specifications of at least one link wire are defined according to the results of the characterization performed during the second step and according to the anticipated performance specifications of the microwave resonator,
- a step of producing the wiring during which the wiring of the link wires is carried out according to the specifications defined in the third step on the structure produced in the first step.

The microwave filter structure proposed by the present invention advantageously implements SIR resonators making it possible both to optimize and widen the passband, and to set the stopband of the band-stop filter in the production phase.

A microwave filter according to the embodiments of the present invention also offers the advantage of being able to be produced by conventional manufacturing means commonly used in the microelectronics field, such as the placement of conductor wires and/or strips of unwound length and of controlled position. The response of the filter can be adjusted by varying the dimensions and the points of attachment of the conductor wires and/or strips.

This adjustment method is particularly suited to high production volumes because it can be totally automated.

This adjustment method also makes it possible to adjust the response of the microwave filter as closely as is necessary, with very small residual spreads linked to the materials and to the production.

This adjustment method also makes it possible to adjust the filtering in situ, that is to say according to the characteristics of the environment of the microwave filter, even according to a number of planned applications, since a number of filtering functions are produced from one and the same microwave filter structure.

Another advantage of the present invention is linked to the fact that the response performance levels of a microwave filter according to the present invention can be adjusted after integration of the whole, making it possible notably to relax the manufacturing tolerances and constraints for a plurality of microwave filter production steps.

Another advantage of the present invention is that it makes it possible to obtain higher impedance ratios than on known impedance stepping resonators, and thus obtain optimized filtering performance levels.

BRIEF DESCRIPTION OF THE DRAWINGS

Other features and advantages of the invention will become apparent on reading the description, given as an example, and in light of the appended drawings which represent.

DETAILED DESCRIPTION

Figure 2:
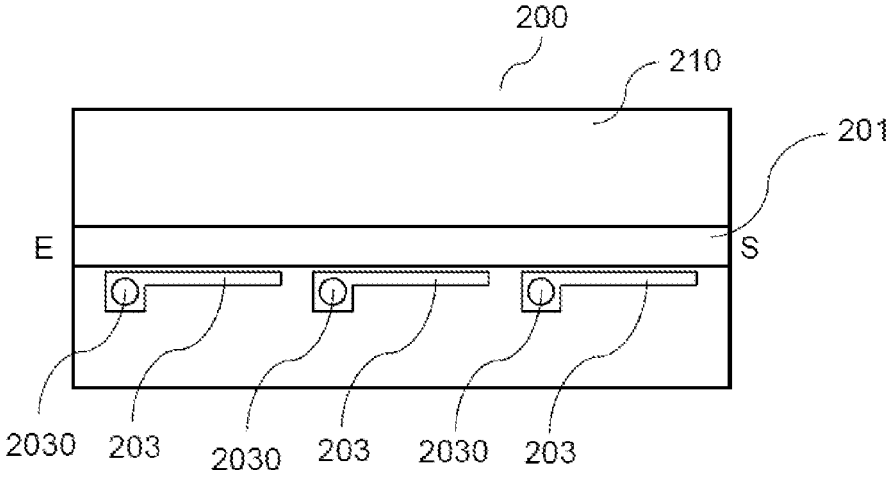
FIG.2 (Prior Art)
FIG. 2, a diagram providing a simplified illustration of the structure of an exemplary band-stop filter with quarter-wave type resonators known from the prior art.
Figure 3:
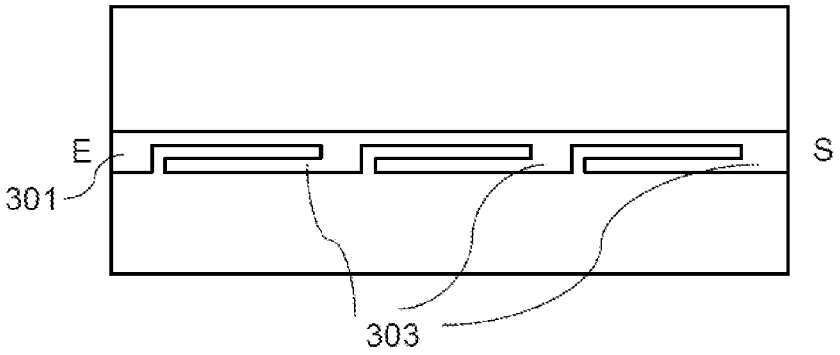
FIG.3 (Prior Art)
FIG. 3, a diagram providing a simplified illustration of the structure of a first exemplary alternative band-stop filter with quarter-wave type resonators known from the prior art.

The microwave filters that are the subject of the present invention may comprise parallel lines coupled with quarter-wave type resonators as illustrated by FIGS. 2 and 3. Compared to other band-stop filter technologies, such as the surface acoustic wave (SAW) or bulk acoustic wave (BAW) filter technologies, such microwave filters present the advantage of offering lower insertion losses, higher power withstand strengths and the possibility of operating at higher frequencies.

Compared to band-stop filters made up of cavities or coaxial resonators, these filters present the advantage of offering a reduced bulk and weight.

The embodiments of the present invention described hereinbelow are based on microstrip-type lines, produced conventionally on a single substrate or else incorporated in a stack of substrates, for example in a tri-wafer type technology, or else produced on a suspended substrate. It should be noted that the present invention applies similarly to the other known production technologies.

It should also be noted that the exemplary embodiments described hereinbelow applying to band-stop microwave filters can be transposed to band-pass microwave filters.

Figure 1:
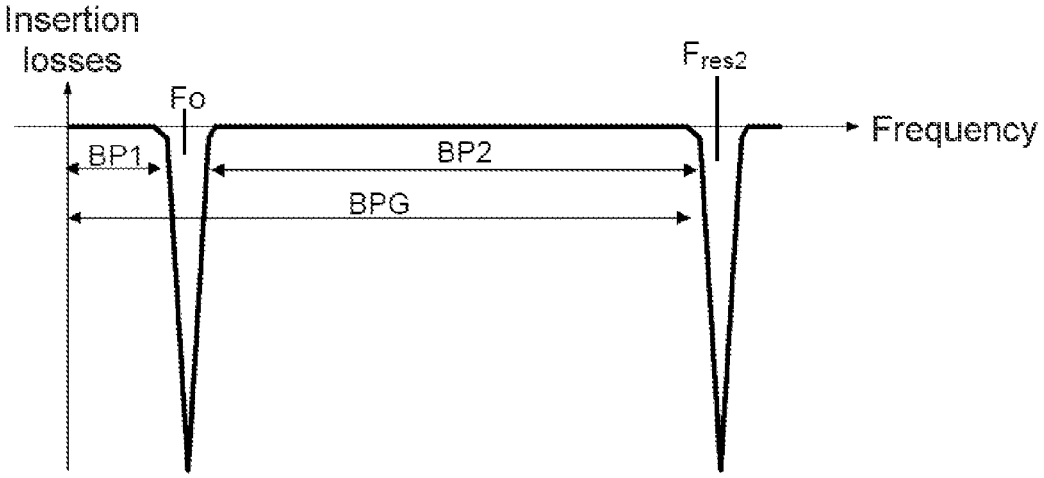
FIG. 1, a curve characterizing the typical performance levels of a band-stop filter known from the prior art.

FIG. 1 shows a curve characterizing the typical performance levels of a band-stop filter known from the prior art.

The curve illustrated by FIG. 1 is represented in a Cartesian reference frame with the y-axis bearing the insertion losses, for example expressed in dB, and the x-axis bearing the frequencies. The curve represented is characteristic of a band-stop filter whose stopband is, in the example illustrated, a narrowband around a fundamental resonance frequency F0. The filter offers a first passband BP1 comprising the frequencies below the fundamental resonance frequency F0, and a second passband BP2comprising the frequencies above the fundamental resonance frequency F0, and below a resonance frequency Fres2. The frequencies below the resonance frequency Fres2 thus define a global passband BPG for the filter. The frequency Fres2 is a spurious resonance frequency, and it is desirable for the latter to be as far away as possible from the fundamental resonance frequency F0. It is thus one of the technical problems that the present invention proposes to resolve, namely maximizing the second passband BP2, the overall passband BPG, and the ratio between the resonance frequency Fres2 and the fundamental resonance frequency F0, i.e.: Fres2/F0.

FIG. 2 shows a diagram giving a simplified illustration of the structure of an exemplary band-stop filter with quarter-wave type resonators known from the prior art.

A band-stop filter 200 comprises a planar transmission line 201 comprising an input E and an output S, between which a microwave signal circulates. A plurality of resonators 203, three in the example illustrated by FIG. 2, are arranged in parallel with the transmission line 201, and thus coupled to the latter. Typically, the transmission line 201 may exhibit an impedance of 50 Ohms.

The filter structure illustrated by FIG. 2 is simplified: notably, the resonators 203 are arranged linearly, parallel to a rectilinear transmission line. In practice, the transmission line 201 may be formed by a plurality of line sections, for example at right angles to one another, and whose lengths are chosen so as to define the characteristics of the filter. Resonators are then arranged parallel to certain line sections.

In the example illustrated by the figure, the resonators 203 are resonators of quarter-wave type. A portion of the transmission line 201 coupled to a resonator can be designated "cell" for microwave filter. The characteristics of the various resonators forming a filter are chosen in such a way as to define the stopband of the filter, or, similarly, the passband when the filter is a band-pass filter. Resonators may, for example, have equal resonance frequencies so as to enhance the rejection in a very fine band around this resonance frequency; resonators may have slightly different resonance frequencies so as to widen the band of rejected frequencies, etc., depending on the configurations which are in themselves known to a person skilled in the art. The resonators 203 may be formed by line sections, of which one end is linked to a land, the land being linked to a via 2030 so as to establish a short circuit with a reference electrode, for example a ground electrode.

The transmission line 201 and the resonators 203 may be produced by metallization on a top face of a substrate 210, the ground electrode being, for example, produced by a metallization on the bottom face of the substrate 210.

FIG. 3 shows a diagram that gives a simplified illustration of the structure of a first exemplary alternative band-stop filter with resonators of quarter-wave type known from the prior art.

Similarly to the structure illustrated by FIG. 2 described above, a microwave filter 300 can be formed by a transmission line 301 comprising an input E and an output S, and a plurality of resonators 303, three in the example illustrated by FIG. 3, produced on a substrate 310. Unlike the structure illustrated by FIG. 2, the resonators 303 can be formed by spurs, commonly referred to as "spur lines", directly inserted in the transmission line 301.

Figure 4:
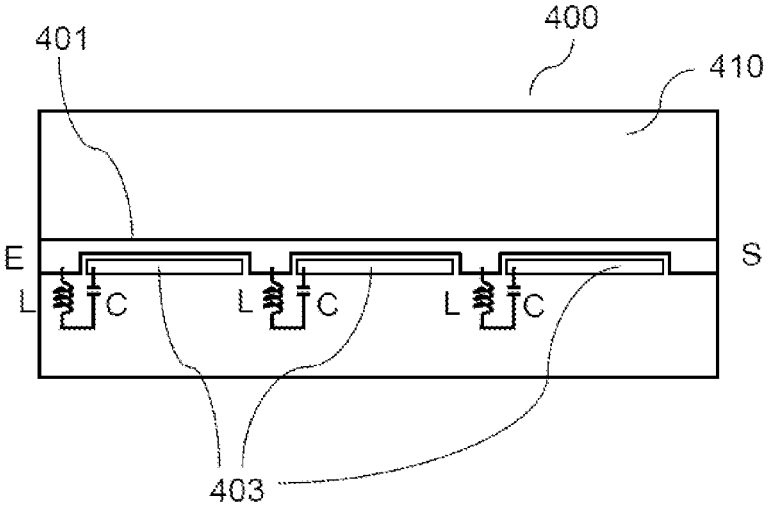
FIG.4 (Prior Art)
FIG. 4, a diagram providing a simplified illustration of the structure of a second exemplary alternative band-stop filter with mixed-type resonators known from the prior art.

FIG. 4 shows a diagram that gives a simplified illustration of the structure of a second exemplary alternative band-stop filter with resonators of mixed type known from the prior art.

A resonator is said to be of mixed type when it is made up of a transmission line and localized elements. Similarly to the structure illustrated by FIG. 3 described above, a microwave filter 400 can be formed by a transmission line 401 comprising an input E and an output S, and a plurality of resonators 403, three in the example illustrated by FIG. 4, produced on a substrate 401. In the example illustrated by FIG. 4, the resonators 403 can be formed by line sections arranged parallel to the transmission line 401, and linked to the transmission line 401 via resonators formed by discrete components mounted in series, typically a self-inductance L and a capacitor C.

Figure 5:
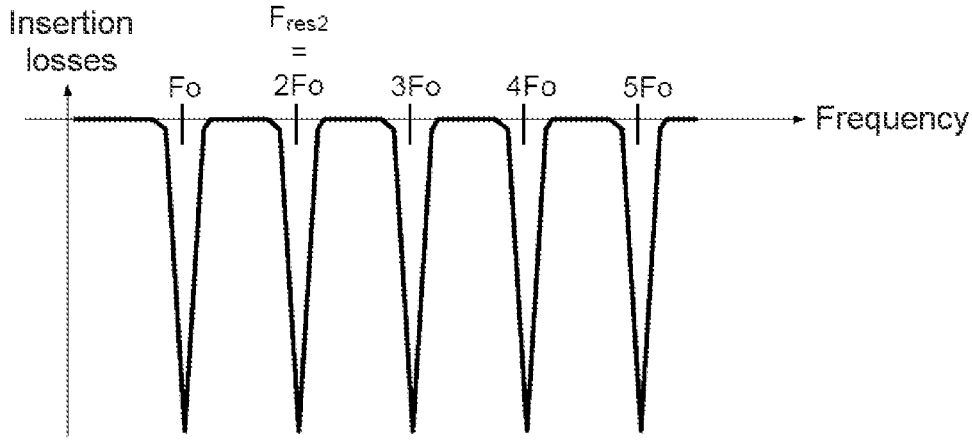
FIG. 5, a curve characterizing the typical performance levels of a band-stop filter with half-wave type resonators known from the prior art.

FIG. 5 shows a curve characterizing the typical performance levels of a band-stop filter with resonators of half-wave type known from the prior art.

Similarly to the curve shown by FIG. 1 described previously, the curve illustrated by FIG. 5 is represented in a Cartesian reference frame in which the y-axis bears the insertion losses, for example expressed in dB, and the x-axis bears the frequencies. The curve represented is characteristic of a band-stop filter whose stopband is, in the example illustrated, a narrowband around a fundamental resonance frequency F0. As described previously, such a microwave filter exhibits a fundamental resonance frequency F0, and higher resonance frequencies equal to the multiples of the fundamental resonance frequency F0, i.e. 2F0, 3F0, 4F0, 5F0, and so on. Thus, the resonance frequency Fres2 delimiting the overall passband of the microwave filter is, in the case of such a filter, equal to 2F0.

Figure 6:
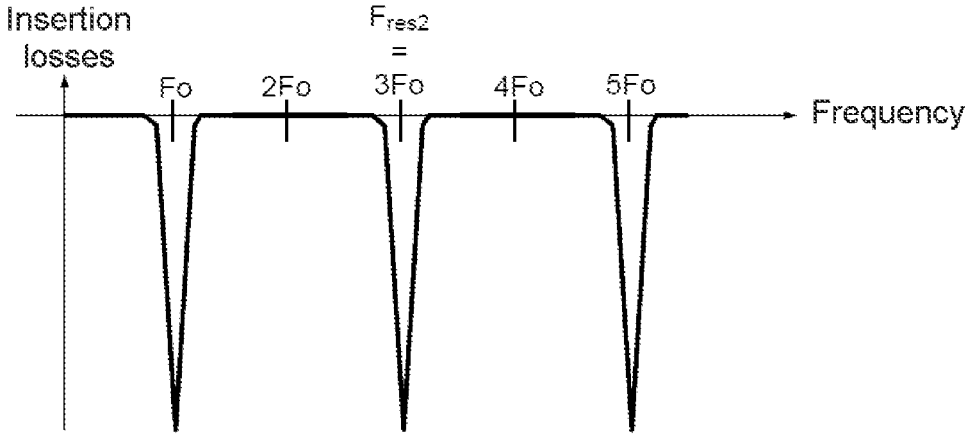
FIG. 6, a curve characterizing the typical performance levels of a band-stop filter with quarter-wave type resonators known from the prior art.

FIG. 6 shows a curve characterizing the typical performance levels of a band-stop filter with resonators of quarter-wave type known from the prior art.

Similarly to the curve shown by FIG. 5 described above, the curve illustrated by FIG. 6 is represented in a Cartesian reference frame in which the y-axis bears the insertion losses, for example expressed in dB, and the x-axis bears the frequencies. The curve represented is characteristic of a band-stop filter whose stopband is, in the example illustrated, a narrowband around a fundamental resonance frequency F0. As described previously, such a microwave filter exhibits a fundamental resonance frequency F0, and higher resonance frequencies equal to the odd multiples of the fundamental resonance frequency F0, i.e. 3F0, 5F0, etc. Thus, the resonance frequency Fres2 delimiting the overall passband of the microwave filter is, in the case of such a filter, equal to 3F0. A microwave filter comprising quarter-wave resonators thus offers advantageous performance levels compared to a microwave filter comprising half-wave resonators, notably in terms of overall passband and ratio Fres2/F0.

Figure 7:
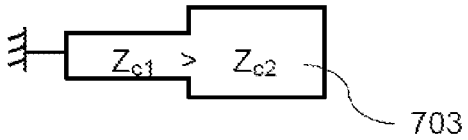
FIG.7 (Prior Art)
FIG. 7, a diagram providing a simplified illustration of the structure of an SIR resonator of quarter-wave type, in itself known from the prior art.

FIG. 7 shows a diagram giving a simplified illustration of the structure of an SIR resonator of quarter-wave type, in itself known from the prior art.

An SIR resonator 703, of quarter-wave type with two sections in the example illustrated by the figure, typically comprises a line section of high impedance Zc1 of a determined length, directly linked to a line section of low impedance Zc2. The line section of high impedance can be linked to a ground electrode. More generally, an SIR resonator comprises a plurality of sections, that is to say at least one high-impedance section and at least one low-impedance section. For example, an SIR resonator of half-wave type, not represented in the figures, comprises a first low-impedance section directly linked to a high-impedance section at a first end of the latter, the second end of the latter being directly linked to a second low-impedance section.

An advantageous structure of an SIR resonator, as illustrated by FIG. 7, is proposed according to the present invention.

Figure 8:
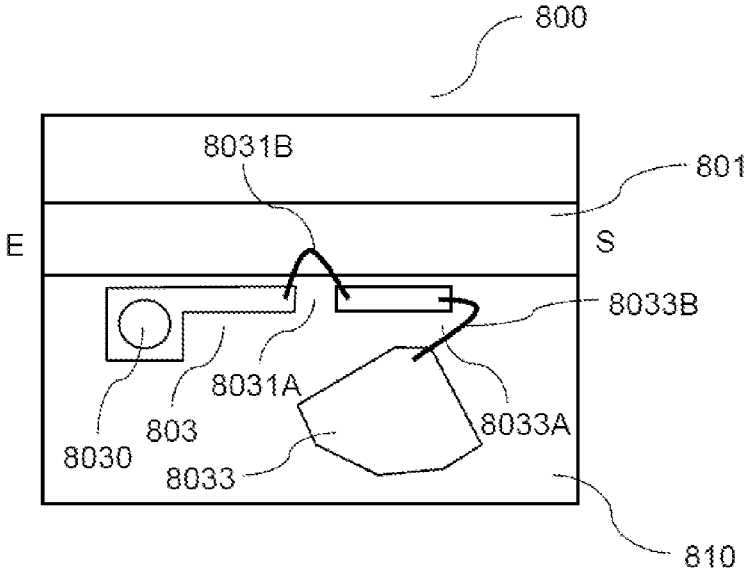
FIG. 8, a diagram illustrating the structure of a cell for microwave filters comprising a resonator according to an exemplary embodiment of the present invention.

FIG. 8 shows a diagram illustrating the structure of a cell for microwave filters comprising a resonator according to an exemplary embodiment of the present invention.

A cell 800 can be produced on a substrate 810, and comprises a transmission line 801 comprising an input E and an output S between which a microwave signal circulates. The cell 800 also comprises an SIR resonator 803 according to an exemplary embodiment of the invention, coupled to the transmission line 801. A microwave filter can be formed by a cell 800 or by the series connection of a plurality of cells 800. The SIR resonator 803 and the transmission line 801 can be produced on a substrate 810, for example in the form of planar transmission lines of strip or microstrip type.

The SIR resonator 803 comprises, in the example illustrated by FIG. 8, a line with high characteristic impedance 8031 of determined length, and a line with low characteristic impedance 8033.

The line of low characteristic impedance 8033 can advantageously be formed by a line section called "stub", for example a stub of butterfly type as in the example illustrated by the figure. Such a structure notably makes it possible to obtain a low impedance in a relatively small bulk.

According to a specific feature of the present invention, the line of high impedance 8031 can comprise a first line cut 8031A, typically an absence of metallization, separating the line of high impedance 8031 into two line sections that are not electrically connected. The resonator 803 also comprises a first link wire 8031B of a determined length ensuring a determined impedance at the first line cut 8031A.

The placement of the first line cut 8031A can be chosen so as to coincide with the area of greatest current amplitude of the line with high characteristic impedance 8031 at the first resonance frequency, that is to say substantially on the side of the short circuit 8030 and with the area of lowest current intensity at the second resonance frequency, in the presence of the first line cut 8031A and of the first link wire 8031B.

For example, the first line cut 8031A can be produced substantially at mid-length of the line with high characteristic impedance 8031.

The first line cut 8031A is produced substantially at a third of the overall length of the microwave resonator 803, starting from the side of an end of the line of high characteristic impedance 8031 opposite to the end of the line of high characteristic impedance 8031 situated on the side of the line of low characteristic impedance 8033. In particular, to obtain a passband that is as wide as possible, above the stopband, a cut and a wire are introduced into the resonator at a position which corresponds to a current maximum, also called current antinode, for the first resonance and with a minimum of current, also called current node, for the second resonance.

This position corresponds approximately to ⅓ of the overall length of the resonator from the short circuit 8030.

Advantageously, the resonator 803 can comprise a second line cut 8033A. In this case, the first line cut 8031A can be shifted toward the short circuit 8030 so as to locate both line cuts 8031A, 8033A in the area which corresponds to the greatest current amplitude at the first resonance frequency and to the weakest current amplitude at the second resonance frequency. Given that, in practice, the maximum length that can be used for the wires is limited by reliability constraints, such as constraints of resistance to impacts, to vibrations, power, etc., and production constraints, such as the need for coupling, it may be advantageous to make use of a plurality of pairs of link wires/line cuts, for example two or three. It has been observed that a second line cut/link wire pair provides more possibilities for optimizing the structure and makes it possible to obtain better results in terms of impedance matching. Depending on the case, the second line cut 8033A may be situated at the junction between the line with high characteristic impedance 8031 and the line with low characteristic impedance 8033. Similarly, a second link wire 8033B ensures the electrical link for the passage of the signal between the line with high characteristic impedance 8031 and the line with low characteristic impedance 8033.

Advantageously, the resonator 803 may comprise a via ensuring an electrical link between a land arranged at one end of the line with high characteristic impedance, and a reference electrode situated, for example, on the bottom face of the substrate 810.

The optimum dimensions of the lines with high impedance 8031 and with low characteristic impedance 8033, of the line cuts 8031A, 8033A and of the link wires 8031B, 8033B can be determined by design in order to satisfy the filter performance requirements.

One advantage obtained by the link wires 8031B, 8033B is linked to the fact that the latter make it possible not only to optimize the response of the cell 800 comprising the resonator 803, but also to allow an adjustment in production of the response characteristics of the cell 800 in a relatively simple manner. It is in fact sufficient to adapt, for example, the length of the first link wire 8031B to adjust the impedance for example of the line with high characteristic impedance 8031 accordingly. This can be done in the course of a microwave filter production process, during a step provided for that purpose, this step being able to follow the steps of production of the different components of the filter, as is described hereinbelow with reference to FIG. 12. One advantage obtained by this embodiment is that it makes it possible to relax the manufacturing tolerances for the production of the elements that make up the microwave filter. Another advantage is that it makes it possible to produce different microwave filters, exhibiting distinct performance characteristics, on a common hardware base, the distinct performance characteristics being able to be obtained from the common base by appropriate choices for the link wires.

The required rejection level for a microwave filter comprising a plurality of cells 800 can be obtained by multiplying the number of cells 800 and by adjusting their resonance frequencies appropriately. Similarly, a plurality of stopbands, for a band-stop filter, can be obtained by the series connection of a plurality of cells 800.

Figure 9:
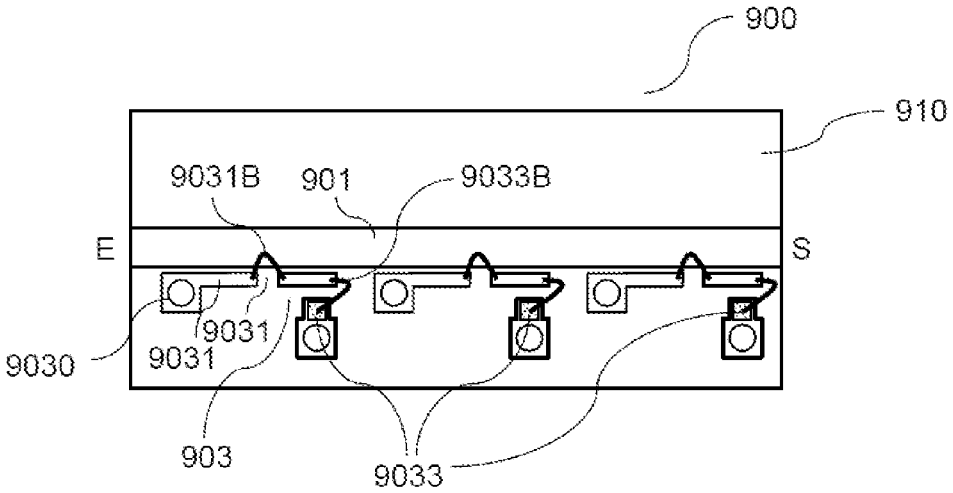
FIG. 9, a diagram providing a simplified illustration of a microwave filter comprising a plurality of cells for microwave filters according to an alternative embodiment of the present invention.

FIG. 9 shows a diagram giving a simplified illustration of a microwave filter comprising a plurality of cells for microwave filters according to an alternative embodiment of the present invention.

A microwave filter 900 as shown in the example illustrated by FIG. 9 can comprise a transmission line 901 comprising an input E and an output S, in parallel with which are arranged a plurality of resonators 903, similar to the quarter-wave type and of which there are three in the example illustrated by the figure, coupled to the transmission line 901, all these elements being able to be produced on the top surface of a substrate 910.

The resonators 903 are, in this example, similar to the resonators 803 included in the cell for microwave filters 800 described previously with reference to FIG. 8, except that the lines with high impedance formed by stubs in the exemplary embodiment illustrated by FIG. 8 can be replaced by capacitors 9033, for example discrete components of SMC type. Moreover, each resonator 903 comprises, like the example illustrated by FIG. 8, a line of high impedance 9031 comprising a first line cut 9031A, a first link wire 9031B ensuring the passage of the signal from one side to the other of the first line cut 9031A. Each capacitor 9033 can, for example, be arranged on a connection land formed by the metallization surface, and comprise a first foil soldered to a second link wire 9033B, and a second foil linked, for example by means of a via 9030, to a reference electrode, for example a ground formed on the bottom face of the substrate 910.

Advantageously, a multilayer structure can be produced by metallization surfaces on and in the substrate 910. Thus, the capacitors 9033 may comprise foils formed by facing metallization surfaces, situated on different layers of the multilayer structure, one of the foils being able to be formed on the surface of the substrate 910, and linked to the second link wire 9033B.

Advantageously, it is possible, in all the exemplary structures described previously, to reinforce the coupling between the transmission line and the line with high impedance of the SIR resonators, for example by superposing these lines in a multilayer structure, or else by subdividing these lines and by interleaving them, like a structure of a coupler called Lange coupler.

A microwave filter structure may comprise a plurality of cells according to various exemplary embodiments described previously.

Figure 10:
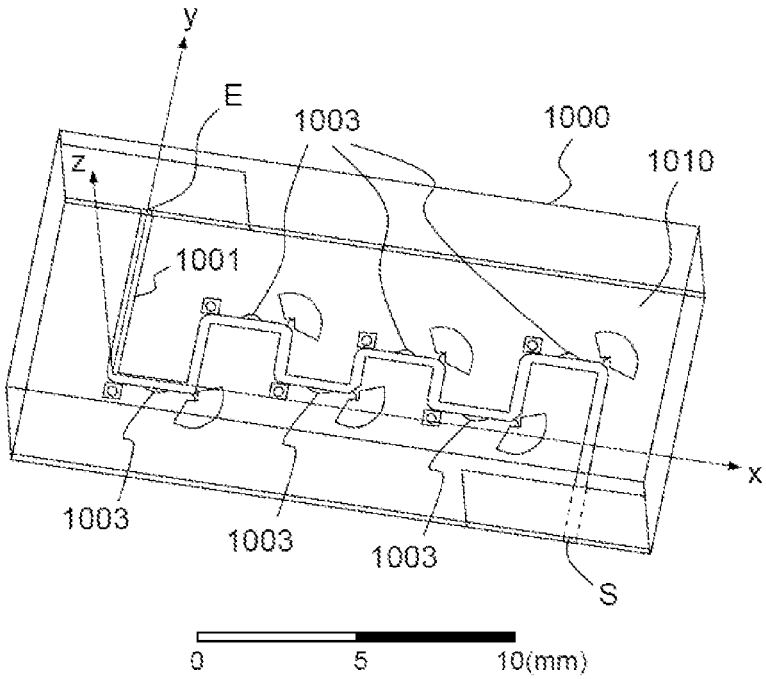
FIG. 10, a diagram illustrating the structure of a band-stop microwave filter comprising a plurality of resonators according to an exemplary embodiment of the present invention.

FIG. 10 shows a diagram illustrating the structure of a band-stop microwave filter comprising a plurality of resonators according to an exemplary embodiment of the present invention.

In the example illustrated by FIG. 10, a microwave filter 1000 may comprise a plurality, six in the example illustrated, of resonators 1003 according to one of the embodiments described previously, coupled to a transmission line 1001 comprising an input E and an output S, these elements being produced on the surface of a substrate 1010. The transmission line 1001 may have a zigzag structure, that is to say comprising a plurality of line sections at right angles to one another. The lengths and the characteristic impedances of the different line sections can be adjusted according to the performance specifications of the microwave filter 1000. The scale is shown in FIG. 10: the sections can typically have lengths of the order of 3 mm, and the large dimension of the microwave filter structure as a whole can be of the order of a centimeter: these dimensions given as nonlimiting examples of the present invention.

Figure 11:
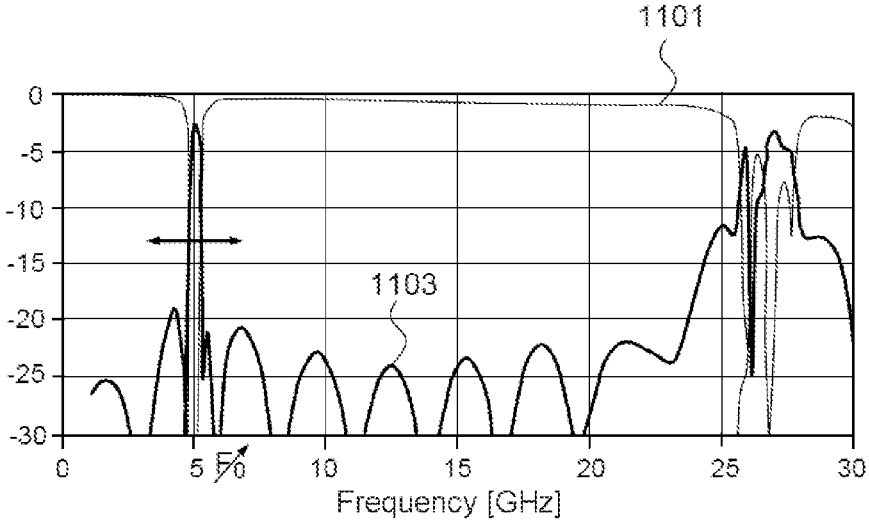
FIG. 11, curves characterizing the performance levels of an exemplary band-stop microwave filter as illustrated by FIG. 10.

FIG. 11 shows curves characterizing the performance levels of an exemplary band-stop microwave filter as illustrated by FIG. 10.

With reference to FIG. 11, a first curve 1101 represents the insertion losses of the microwave filter, for example expressed in dB, as a function of the frequency born on the x-axis, and a second curve 1103 represents the matching of the microwave filter, for example expressed in dB, as a function of the frequency.

As is illustrated by the curves 1101 and 1103, such a microwave filter structure makes it possible to obtain a fundamental resonance frequency F0 of the order of 5 GHz, and a first resonance frequency Fres2 higher than 25 GHz. The fundamental resonance frequency F0 can be varied by adjusting the link wires included in the resonators. When a line cut/link wire pair coincides with a current amplitude minimum at the second resonance frequency and a current amplitude maximum at the first resonance frequency, then the length of the link wire allows for an adjustment of the fundamental resonance frequency F0 with maximum effectiveness and a very small modification of the first resonance frequency Fres2.

Figure 12:
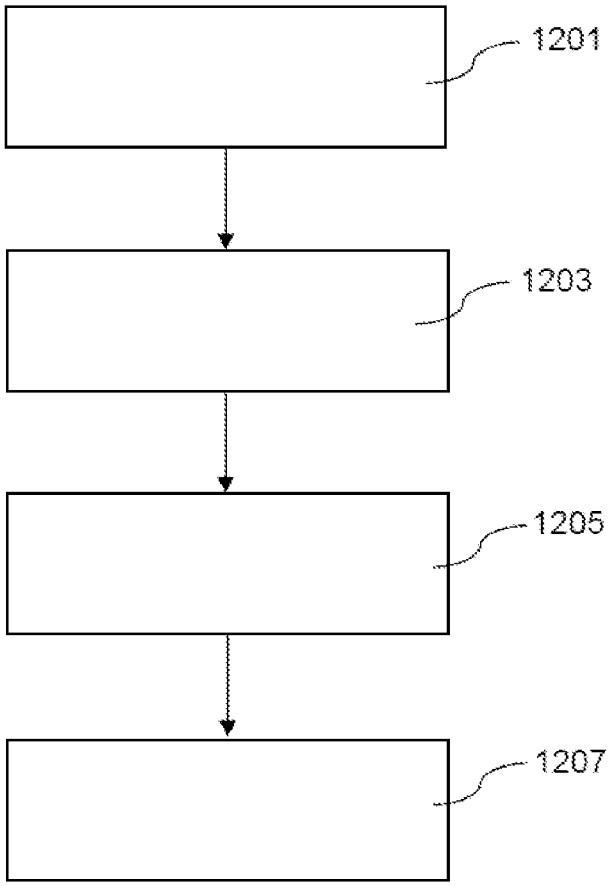
FIG. 12, a diagram illustrating a method for producing a microwave resonator, in an exemplary embodiment of the present invention.

FIG. 12 shows a diagram illustrating a method for producing a microwave resonator in an exemplary embodiment of the present invention.

The production of a microwave resonator according to one of the embodiments described previously, and by extension of a cell for microwave filters or a microwave filter structure, may comprise a first step 1201 of producing the main components, that is to say lines of high and low characteristic impedance, line cuts, the transmission line, vias and reference electrodes, as appropriate. The first step 1201 can be carried out via production techniques that are in themselves known, for example by metallizations on a substrate, for example according to technologies of strip or microstrip type, possibly forming multilayer structures as was described previously.

The first step 1201 can be followed by a second step 1203 of characterization of the performance levels of the structure of the microwave resonator and of the cell or of the filter thus obtained. Since this structure is not functional in terms of the first step 1201, the link wires as yet not being in place, the characterization of the performance levels can be carried out by means of a dimensional characterization.

The second step 1203 can then be followed by a third step 1205 of adjustment during which the specifications of the link wires can be defined, according to the results of the characterization carried out during the second step 1203 described above, and according to the anticipated performance specifications.

A wiring production step 1207 may then consist in producing the final wiring of the microwave filter or filters with the optimum dimensions as determined in the preceding steps.

The invention claimed is:

1. A microwave resonator with impedance jump, comprising at least one line of high characteristic impedance of a determined length and one line of low characteristic impedance, at least the line of high characteristic impedance comprising a first line cut, a first link wire of a determined length ensuring a determined impedance at the first line cut, said first line cut being produced substantially at one third of the overall length of the microwave resonator starting from the side of an end of the line of high characteristic impedance opposite to the end of the line of high characteristic impedance situated on the side of the line of low characteristic impedance, wherein said first line cut is produced substantially at mid-length of the line with high characteristic impedance.

2. The microwave resonator according to claim 1, wherein it comprises a second line cut, a second link wire of a second determined impedance ensuring an electrical link for the passage of a signal from one side to the other of the second line cut.

3. The microwave resonator according to claim 2, wherein the second line cut is situated between the line with high characteristic impedance and the line with low characteristic impedance.

4. A microwave filter of band-rejection type, comprising a transmission line, coupled to a plurality of microwave resonators at least one of which is the microwave resonator according to claim 1.

5. The microwave resonator according to claim 1, wherein said at least one line of high characteristic impedance and one line of low characteristic impedance are produced in the form of metal tracks printed on a substrate, in the form of planar line sections of strip or microstrip type.

6. The microwave resonator according to claim 5, wherein the line of low characteristic impedance is formed by a stub of butterfly type, also called radial stub.

7. The microwave resonator according to claim 5, wherein the line of low characteristic impedance is formed by a capacitor mounted on the substrate, of which a first foil is connected to said second link wire, and a second foil is linked to a reference electrode.

8. The microwave resonator according to claim 7, wherein the line of low characteristic impedance, the line of high characteristic impedance and the capacitor are situated on a top face of the substrate, the reference electrode being a ground electrode situated on a bottom face of the substrate, said second foil of the capacitor being connected to the reference electrode by means of a via passing through the substrate.

9. The microwave resonator according to claim 7, wherein the microwave resonator is produced in a structure of multilayer type produced in the substrate, the capacitor being incorporated in the multilayer structure.

* * * * *